US006256922B1

(12) United States Patent
Jones et al.

(10) Patent No.: US 6,256,922 B1
(45) Date of Patent: Jul. 10, 2001

(54) FIREARM CASING

(75) Inventors: Brent Jones, Greer; Robert Lawrence Parker, Clarkshill; Phillip Durham, Greer, all of SC (US)

(73) Assignee: Innovative Sports, Inc., Greer, SC (US)

( * ) Notice: Subject to any disclaimer, the term of this patent is extended or adjusted under 35 U.S.C. 154(b) by 0 days.

(21) Appl. No.: 09/252,533

(22) Filed: Feb. 18, 1999

Related U.S. Application Data

(63) Continuation-in-part of application No. 09/082,591, filed on May 21, 1998.

(51) Int. Cl.[7] ..... F41A 35/04
(52) U.S. Cl. ..... 42/96
(58) Field of Search ..... 42/96; 206/317; 224/913

(56) References Cited

U.S. PATENT DOCUMENTS

| | | | | |
|---|---|---|---|---|
| Re. 32,752 | | 9/1988 | Kiang | 150/52 R |
| D. 372,121 | | 7/1996 | Rowe | D3/262 |
| 2,737,136 | * | 3/1956 | Ryder | 112/262 |
| 3,191,652 | * | 6/1965 | Benson et al. | 150/52 |
| 3,239,114 | * | 3/1966 | Norsworthy | 224/2 |
| 3,437,247 | | 4/1969 | Gantress | 224/2 |
| 3,701,371 | | 10/1972 | Stackhouse | 150/52 R |
| 3,865,166 | | 2/1975 | Pedro | 224/2 A |
| 4,249,687 | | 2/1981 | Warnier | 224/913 |
| 4,433,500 | | 2/1984 | Kunevicius | 42/1 N |
| 4,597,213 | * | 7/1986 | Musgrave | 42/90 |
| 4,754,498 | | 7/1988 | Stinemates | 2/17 |
| 4,756,456 | | 7/1988 | Schauer | 224/150 |
| 5,678,344 | | 10/1997 | Jones et al. | 42/96 |

* cited by examiner

*Primary Examiner*—Michael J. Carone
*Assistant Examiner*—Michelle Thomson
(74) *Attorney, Agent, or Firm*—Dority & Manning, P.A.

(57) ABSTRACT

A firearm casing 10 for protecting a firearm 250 from the elements while allowing the user to access the firearm handle or sight 150 and trigger 290. The firearm casing 10 having a body 20 with a front portion 30, a rear portion 40, an upper longitudinal edge 260, a lower longitudinal edge 270, an end flap 10, a terminal aperture 210, an upper flap 50 and a lower flap 60. The lower longitudinal edge 270 having an access opening 280 permitting insertion of a firearm 250 and access to the trigger 290. The access opening 280 covered by the lower flap 60 with fastening means 160. The upper longitudinal edge 260 defining an upper aperture 300 for accessing a handle or sight 150 and the insertion and ejection of shells. The upper opening 300 covered by the upper flap 50 which protects the firearm 250 from the elements. The preferred fastening means used throughout being a hook and loop fastener such as VELCRO®, however any conventional type such as, but not limited to, a zipper, snaps, buttons or hook may also be employed. The terminal aperture 210 may have a fastening means 160 for closing the terminal aperture 210 to prevent foreign objects such as dirt and debris from entering the barrel of the firearm 250 through the open end.

19 Claims, 5 Drawing Sheets

FIREARM CASING

This application is a continuation-in-part application of application Ser. No. 09/082,591, filed May 21, 1998 entitled Improved Firearm Casing Device.

BACKGROUND OF THE INVENTION

1. Field of Invention

The present invention relates to the art of firearm casings. More particularly, this invention is related to a protective cover for a firearm which permits the firearm to be sighted, discharged and transported while remaining protected from the elements.

2. Description of Prior Art

There are various devices which can be employed to encase a firearm, however many are limited as they do not permit use of a firearm sight or discharge of shells while the firearm is enclosed in such casing. Various gun casings, covers and methods of construction are prevalent in the prior art and referenced below.

The U.S. patent issued to Gantress, U.S. Pat. No. 3,437,247, discloses a cover for protecting a rifle from the elements while permitting the firearm, enclosed in the cover, to be fired. The invention of Gantress does allow access to the rifle through the bottom of the cover. However, Gantress's apparatus does not permit use of a sight while the rifle is enclosed in the cover.

The U.S. patent issued to Stackhouse, U.S. Pat. No. 3,701,371, is directed to a gun case that is capable of being folded up to fit in a person's shirt pocket when not in use. The case, when being used, has openings permitting the access to the trigger of a gun. However, Stackhouse's apparatus does not permit a firearm to be aimed utilizing its sight while so encased.

The patent to Pedro, U.S. Pat. No. 3,865,166 discloses a weapon case having handles and used for storing and carrying the weapon, but does not allow the weapon to be used while in the protective covering.

The Kunevicius patent, U.S. Pat. No. 4,433,500, shows a gun glove consisting of two separate pieces. The front piece being a sleeve which slides over the front portion of a firearm to protect it and the rear piece being a zippered sleeve with a VELCRO® type fastening means on the rear end which helps to encompass the stock of the firearm. This gun glove does allow access and use of the firearm while in use, but does not fully encase or protect the entire firearm.

The U.S. patent issued to Stinemates, U.S. Pat. No. 4,754,498, is directed to a gun mitten which is a protective cover for the stock portion of a firearm. While the Stinemates apparatus allows access to the firearm while in used, it also only covers the stock portion of the firearm and does not allow for an ammunition clip to be used with the firearm while the mitten is in place.

U.S. Pat. No. 4,756,456 issued to Schauer shows a gun case for protecting a firearm from the elements while being carried in the field. Schauer's apparatus does not allow for use of the firearm while it is within the case.

The Jones et al. patent, U.S. Pat. No. 5,678,344, entitled "Firearm Casing Device" and incorporated herein by reference, shows a protective firearm casing which allows the firearm to be discharged while the cover is in place and it also allows for a sight to be used while on the firearm. The Jones et al. casing does not form fit the firearm or have a lower flap mechanism which allows for maximum coverage and protection as well as easy accessibility and the use of an ammunition clip all while the cover is in place.

The patent issued to Kiang, U.S. Pat. No. Re 32,752, discloses a long barreled firearm protective covering comprised of two separate elements. The first element being a sleeve which slides onto the middle portion of the firearm. The second element being a zippered pouch that slides over the rear portion of the firearm and covers the butt of the gun while also holding extra ammunition. A shortcoming of the Kiang device is that the ammunition can easily fall out of the ammunition holder and also must always be used in conjunction with the butt of the firearm.

The Warnier patent, U.S. Pat. No. 4,249,687, discloses a weapon casing that is contoured to fit the shape of the firearm, even including a sight, and includes a carrying strap but does not allow access to operate the firearm while it is encased in the cover.

Also, the application issued to Rowe, U.S. Des. 372,121, shows a gun case having a somewhat contoured fit and carrying strap but also does not allow the firearm to be operated while within the carrying case.

While the above stated devices are a fair representation of the current prior art, there remains room for improvement as defined by the currently claimed invention.

SUMMARY OF THE INVENTION

It is thus an objective of the present invention to provide a means for protecting a firearm from the elements while accessing a sight in aiming and discharging the firearm.

It is a further objective of the invention to provide such protection adaptable to various kinds and sizes of firearms.

It is yet another objective of the invention to provide such protection which is easily transportable.

It is an additional objective of the invention to provide a firearm cover that can be used in conjunction with the sighting means on the firearm.

Another objective of the present invention is to provide a protective cover which allows for shell casings to be discharged from the firearm while the cover is in use.

A further objective of the present invention is to have a protective casing which is lightweight, waterproof, and folds to a reduced size for storage when not in use.

Yet another objective of the present invention is to provide a protective casing for a firearm which has either foldable or removable flaps that cover and uncover the firearm sight, portion of the firearm where the shells are inserted and discharged as well as the portion of the firearm where a magazine is inserted.

And still a further objective of the present invention is to make a protective firearm cover which extends out past the front barrel of the firearm and can be closed off so as to prevent dirt and debris from entering the barrel of the firearm through the front opening.

An objective of the this firearm casing and ammunition pouch is also to allow for shoulder straps to be attached to the firearm while the casing is in place and being used.

And another objective of this invention is to allow for a protective covering for a magazine and the magazine to be used in conjunction with the firearm while the casing is in use on the firearm.

The aforementioned objectives will be accomplished as well as other features and advantages of the present invention will become more apparent from the following detailed description of a firearm casing having an elongated cover contoured to fit the shape of a firearm. The casing or cover (both terms used interchangeably) having opposing panels forming an upper longitudinal edge, a lower longitudinal edge, a stock end and a terminal aperture. The lower longitudinal edge having an access opening permitting insertion of a firearm and access to a firearm trigger. The access opening having a first fastener for closing the access opening. The upper longitudinal edge defining an upper aperture for accessing a sight and the insertion and ejection of shells. The upper aperture having a second fastener for closing the upper aperture. The second fastener being of any conventional means such as but not limited to a zipper, snaps, buttons or hook and loop fasteners such as VELCRO®. The cover may also have a flap folded over the upper aperture and secured to the cover by a third fastener of convention means as stated above. The terminal aperture having a fourth fastener for closing the terminal aperture. The description of the present invention discloses, in conjunction with the drawings which illustrate by way of example, the principles and objectives of the invention.

DETAILED DESCRIPTION

In accordance with this invention, it has been found that a firearm casing can be provided to enclose and protect a firearm from the elements while enabling the user to access the firearm sight, trigger, opening for inserting and ejecting ammunition, magazine connection, carrying and strap. The protective cover, shaped to match the contours of the firearm, allow for the firearm to be maintained in a state of readiness and to be discharged while enclosed in the cover. All flap portions of the cover are constructed with numerous connecting means such as hook and loop fasteners like VELCRO®, snaps, buttons, hooks or zippers so that the flaps can be maintained in a variety of positions. For example, when the upper flap is in an open position, it can either form a roof-like structure over the top portion of the firearm, where the sight is located or where shells are discharged, and protect the firearm from the elements or if so desired, the flap can be folded or rolled down and attached at the side of the firearm so that is out of the user's way, the upper flap can also be completely removed from the casing should it be necessary. On the lower portion of the cover is the lower flap which is similar in structure to the upper flap and is used to mask and unmask the trigger portion or magazine portion of a firearm depending upon the actual style of firearm upon which the cover is being used. This lower flap can also be rolled or folded down, away from the firearm and secured to the side of the firearm or it can be allowed to simply hang loosely in an unobtrusive fashion. The casing may also allow for a sighting bead which is located at the end of the firearm wherein the casing terminates just prior to the sight bead thus leaving the sight bead exposed and unobstructed. An alternative version of the cover may also extend over the sight bead at the end of the barrel portion of the firearm, so that the sight bead protrudes up through an opening in the protective cover hence maintaining its accessibility when aiming the firearm and protecting the end of the firearm.

Figure 1:
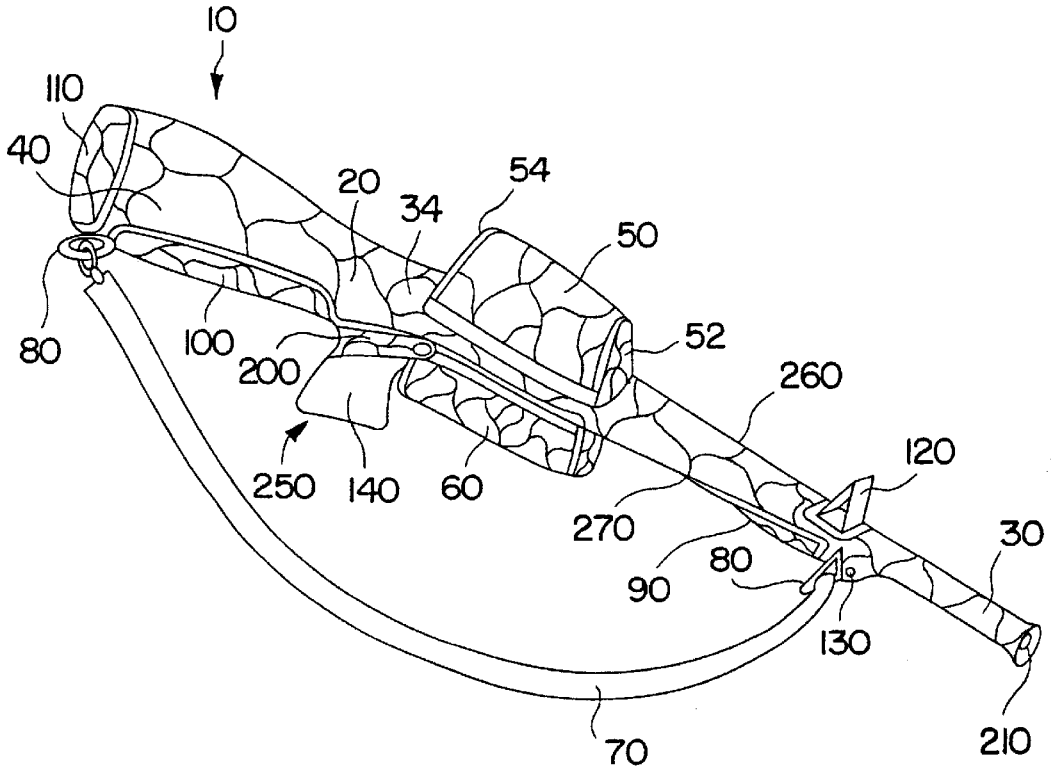
FIG. 1 is a front perspective view showing a first embodiment of the firearm casing with the upper flap and the lower flap in the closed position.

FIG. 1 is a front perspective view showing a first embodiment of the firearm casing 10 with the upper flap 50 and lower flap 60 fully covering the firearm 250. FIG. 1 illustrates the firearm casing 10 has a body 20 that is comprised of a front portion 30, a middle portion 34 and a rear portion 40. The firearm casing 10 may be fabricated from a suitable water resistant or waterproof material, which is preferably camouflaged, such as GORTEX® fabric, vinyl or sturdy canvas treated with a water repellant finish. The material can also be of solids and various types of patterns, prints and colors, however the preferred embodiment is camouflage which is particularly applicable if the firearm being covered is used in hunting certain animals that can differentiate objects of solid colors. Firearm 250 is enclosed in casing 10. Firearm casing 10 has an upper longitudinal edge 260 (FIG. 2) having an upper aperture 300 formed therein for a handle or sight 150 as well as a sight opening 310 near the front portion 30 of the body 20 for the sight bead 120. Firearm casing 10 also has lower longitudinal edge 270 which has an access opening 280 that is selectively sealed along portions of it (FIG. 2) which permits insertion of a firearm 250. Once a firearm 250 is inserted into the firearm casing 10, the unsealed portions of lower longitudinal edge 270 permit access and use of the firearm's trigger 290 (FIG. 2) and also to the attached carrying strap 70, if any.

Figure 2:
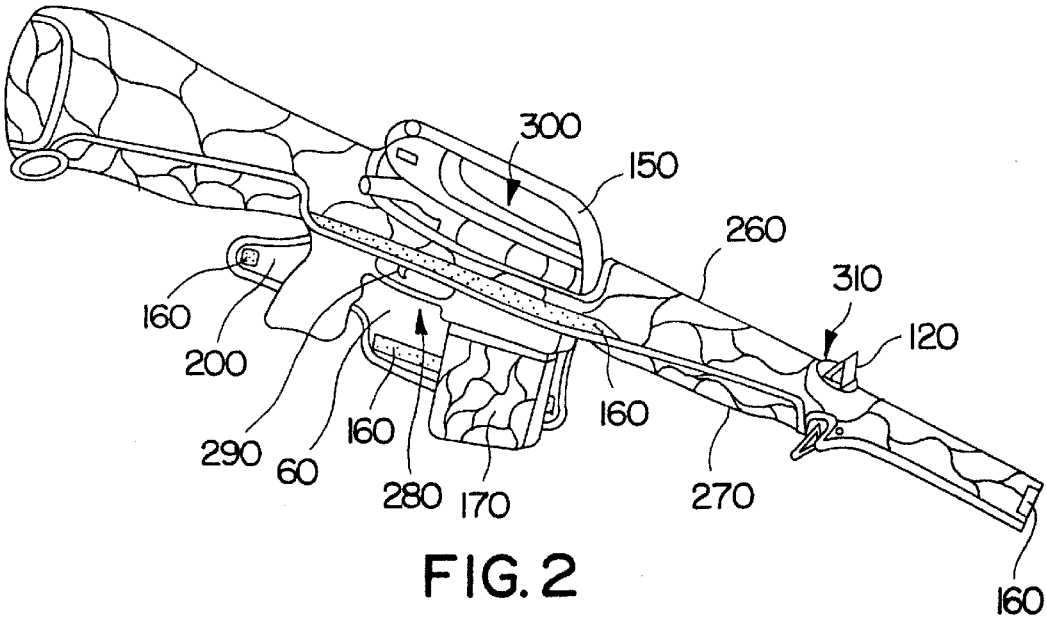
FIG. 2 is a front perspective view thereof showing the upper flap removed from the casing and the lower flap opened to expose the firearm and magazine with cover.

Contiguous with the lower longitudinal edge 270 at the rear portion 40 of the body 20 is the stock flap 110 that covers the stock end of the firearm 250 and the barrel flap 90 that covers the barrel end of the firearm 250. The end flap 110 is located at the rear portion 40 of said body 20 and between the upper longitudinal edge 260 and the lower longitudinal edge 270 and is oriented latitudinally. Terminal aperture 210 at the front portion 30, opposite the stock flap 100, permits the firearm 250 to be discharged while encased in the firearm casing 10. Terminal aperture 210 may be selectively closed around the barrel of firearm 250 by a fastening means 160, such as a hook and loop fastener like VELCRO®, a snap, button, hook or other conventional fasteners. FIG. 2 is a front perspective view of the firearm casing 10 showing the top flap 50 removed from the body 20 and the lower flap 60 opened to expose the firearm 250 and firearm magazine with cover 170. FIG. 2 shows the protrusion of handle 150 from the upper aperture 300. An extended portion of the body 20 forms the lower flap 60 which can be opened to allow access to the trigger 290 and also to attach the magazine. Lower flap 60 is comprised of a flexible, water resistant material and has a grip flap 200 which is used to wrap around the grip 140 of the firearm 250 so as to more completely cover the majority of the firearm 250. When the upper flap 50 is in an open position, it can be position in an arching position over the handle so as to protect it from the elements, or from the glare of the sun, thus providing the user an enhanced line of sight. The upper flap 50 can also be folded back or rolled back upon itself and fastened with fastening means 160 as previously describe so as to keep the upper flap 50 in a secure position and out of the way. In addition, the upper flap 50 comprises a forward edge 52 and a rear edge 54 formed by pleats 220 sewn in the fabric so as to form a tent-like structure which extends over the handle 150. When the upper flap 50 is in a partially closed position, the forward edge 52 of the upper flap 50 extends beyond the front of the handle 150 thus protecting the handle from becoming obscured by foreign objects and elements such as rain, snow or debris that might fall from the surrounding environment. The forward edge 52 may also provide some shading over the handle or sight 150 in times of bright sunlight. The upper flap 50 is fastened to firearm casing 10 by fastening means 160 which is preferably a hook and loop fastener such as Velcro®. Other fastening methods such as zippers, buttons, hooks and snaps may be employed. Also in FIG. 2, firearm casing 10 may include a sight opening 310 at the front portion 30 of the firearm casing 10 near the terminal aperture 210. This sight opening 310 is positioned near the terminal aperture 210 to allow the user to properly aim the firearm 250 by using any sight thereon. The sight opening 310 may be used with firearms 250 equipped with sights and also with firearms 250 without sights or with removable sights. Furthermore, firearm casing 10 may be easily folded and carried in the field in an accompanying case (not shown) preferably made of the same water resistant material, thus making the cover accessible, transportable and storable.

Figure 3:
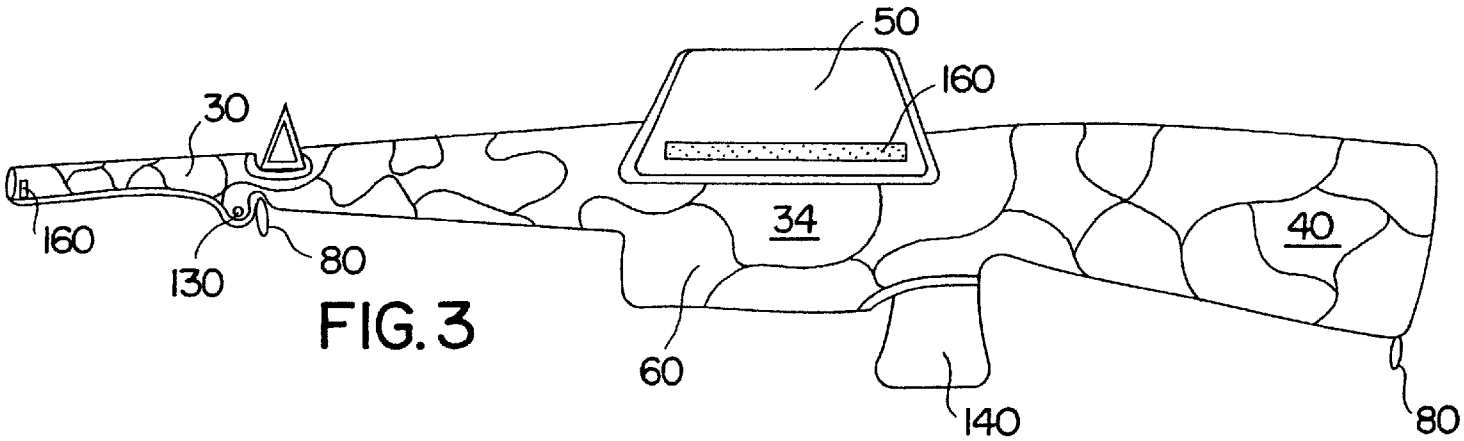
FIG. 3 is a rear elevation view thereof showing both the upper flap and lower flap in closed positions.

FIG. 3 is a rear elevation view of the firearm casing 10 showing the upper flap 50 and lower flap 60 in closed positions. The lower flap 60 wraps around the grip 140 of the firearm 250 and fastens to itself on the opposite side of the firearm casing 10. The upper flap 50 has an outer fastening means 162 on each side of the upper flap 50 which are used to secure the upper flap 50 in place when it is attached to the firearm casing 10 and when the upper flap 50 is folded down or rolled down on itself. There is also a middle fastening means 164 located in the middle of the inside of the upper flap 50 that will attach to an outer fastening means 162 shown in FIG. 3. As the edge of the upper flap 50 is rolled or folded down, the middle fastening means 164 will become exposed and then attached to the outer fastening means 162 so as to prevent the upper flap 50 from moving freely about. This detail will also be discussed in more detail in reference to FIGS. 4 & 5.

Figure 5:
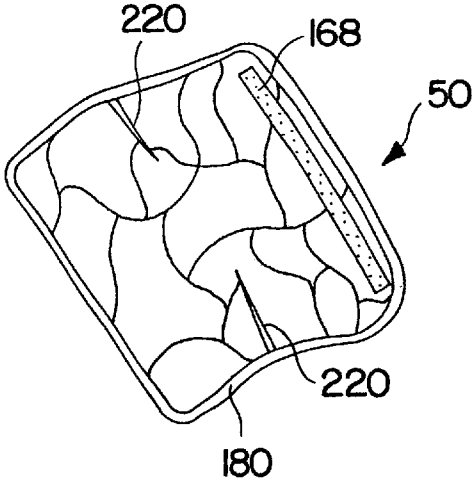
FIG. 5 is a bottom perspective view thereof.
Figure 4:
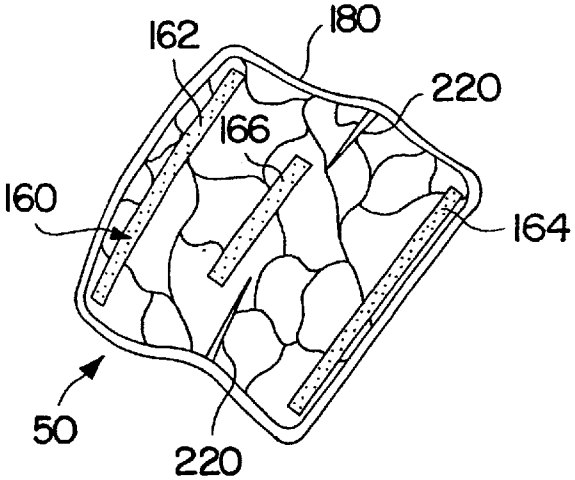
FIG. 4 is a top perspective view of the upper flap itself, as removed from the firearm casing.

FIGS. 4 is a bottom perspective view of the upper flap 50 itself, as removed from the firearm casing 10 and FIG. 5 is a top perspective view thereof. The upper flap 50 is generally a polygonal shape, in this preferred embodiment rectangular or square, and has a decorative and finishing border or trim 180 around the entire perimeter. There are at least two darts 220 sown in the upper flap 50 which cause it to angle slightly forming a tent-like structure which allows it to more closely fit over the handle 150 of the firearm when in place on the firearm casing 10. FIG. 4 is the bottom or inside of the upper flap 50 and has at least three fastening means 160 attached thereto by any conventional attachments means such as sewing or gluing. There are at least two outer fastening means 162 and at least one middle fastening means 164. FIG. 5 shows the top or outside of the upper flap 50 which also has at least one outer fastening means 162. When in the closed position on the firearm casing 10, the upper flap 50 is attached to a fastening means 160 in the middle portion 34 of the body 20 of the firearm casing 10 with outer fastening means 164, the upper flap 50 extends over the handle 150 of the firearm 250 and is attached to a another fastening means 160 on the firearm casing 10 on the opposite side of the firearm 250 with outer fastening means 162. In this position, the outer fastening means 168 is exposed to the elements. When the upper flap 50 is placed in an open position, the outer fastening means 162 is disconnected and either allowed to dangle freely or is rolled down upon itself. When the upper flap 50 is rolled or folded down upon itself, the middle fastening means 166 is exposed and connected to the outer fastening means 168 on the outside of the upper flap 50 securing the upper flap 50 into a specific position.

Figure 6:
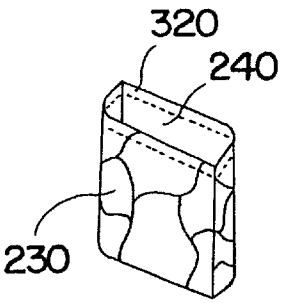
FIG. 6 is a front perspective view of the magazine casing.

FIG. 6 is a front perspective view of the magazine casing 230. Certain firearms 250 require a separate, external magazine to be used to insert ammunition into the firearm 250. When a firearm 250 of this type is used, a magazine casing 230 can be used in conjunction with the firearm casing 10 so as to keep a majority of the firearm 250 covered. The magazine casing 230 is made of the same water-proof material as the firearm casing 10 and both the upper and lower flaps 50,60. The magazine casing 230 is a box-like structure having an opening 240 within which the magazine is inserted and removed. The magazine casing 230 can have an elastic band or drawstring 320 around the outer perimeter of the opening 240 which will help to keep the magazine casing 230 in place on the magazine and prevent slippage while being used.

Figure 7:
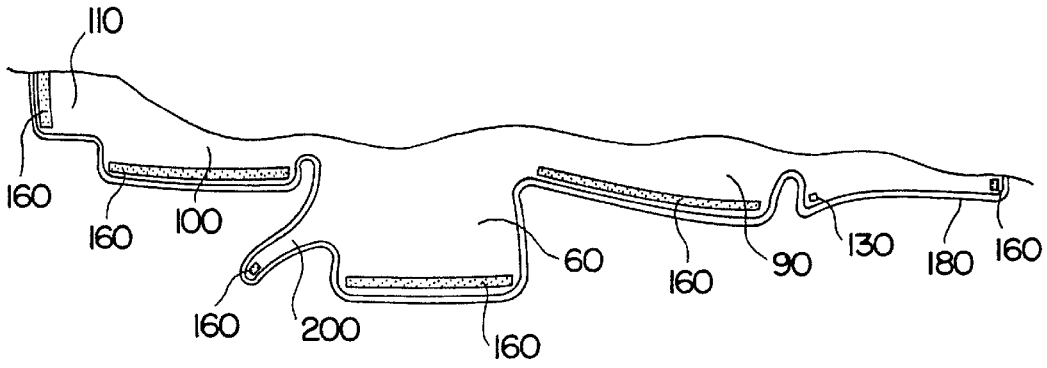
FIG. 7 is a broken-away side elevation view of the lower portion of the inside of the firearm casing.

FIG. 7 is a broken-away side elevation view of the lower portion of the inside of the firearm casing 10. This figure discloses the fastening means 160 located in various positions throughout the firearm casing 10. The firearm casing 10 is sleeve-like in that it wraps around the firearm 250 and encloses it with fastening means 160 located primarily along the lower longitudinal edge 270. When the firearm 250 is placed within the firearm casing 10, it is inserted through the lower longitudinal edge 270 and the fastening means 160 are then attached to mating fastening means 160 on the opposite side of the firearm casing 10. After the firearm is inserted into the firearm casing 10, the stock flap 100 is folded up and connected with a mating fastening means 160. The end flap 110 is folded around the butt end of the firearm 250 and mating attached with a fastening means 160 located on the rear portion 40 of the firearm casing 10. The barrel flap 90 is also folded up and mating connected with a fastening means 160 on the front portion 30 of the body 20. The lower flap 60 is folded up and matingly connected to a fastening means located on the middle portion 34 of the body and the grip flap 200 is then wrapped around the grip 140 of the firearm 250 and matingly connected with a fastening means on the lower flap 60. The strap attachment device 80 (shown in FIG. 1) is allowed to protrude out from the firearm casing 10 and the firearm casing 10 is matingly connected with strap attachment fastening means 130. From the strap attachment fastening means 130 to the terminal aperture 210 (shown in FIG. 1), the firearm casing can either be removably connected along the lower longitudinal edge or, as in the preferred embodiment, it can be permanently connected by being sewn or glued, thus providing for a long, narrow sleeve portion within which the barrel of the firearm 250 is inserted until the end of the barrel is at or near the terminal aperture 210 of the firearm casing 10. To disassemble and remove the firearm casing 10 from the firearm 250, the various fastening means 160,130 are merely disconnected and the firearm casing 10 is slipped off the firearm 250 at which time it can easily be folded and washed, or placed into a storage pouch or pocket until needed again.

Figure 8:
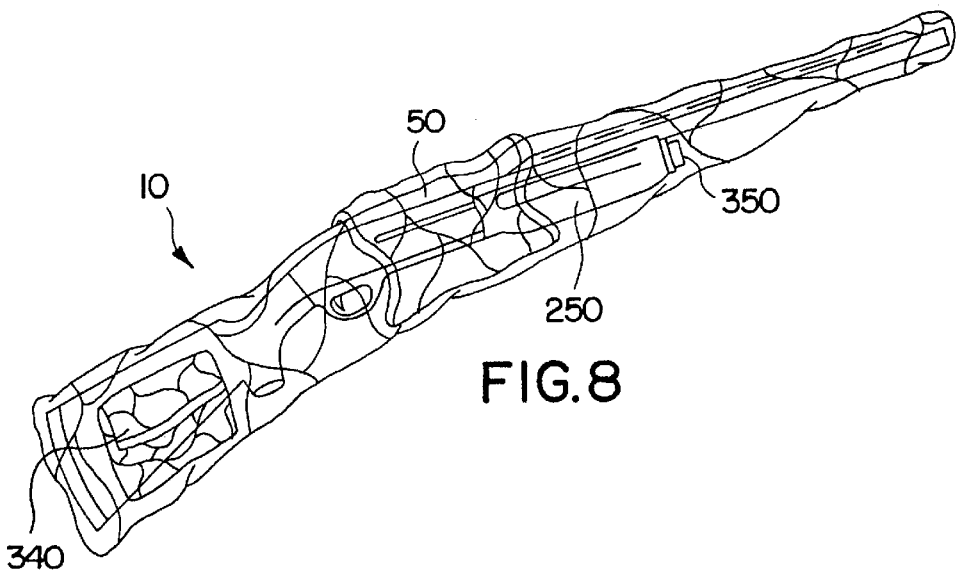
FIG. 8 is a perspective view of a second embodiment of the firearm casing having only an upper flap in the closed position thereby covering the firearm.
Figure 9:
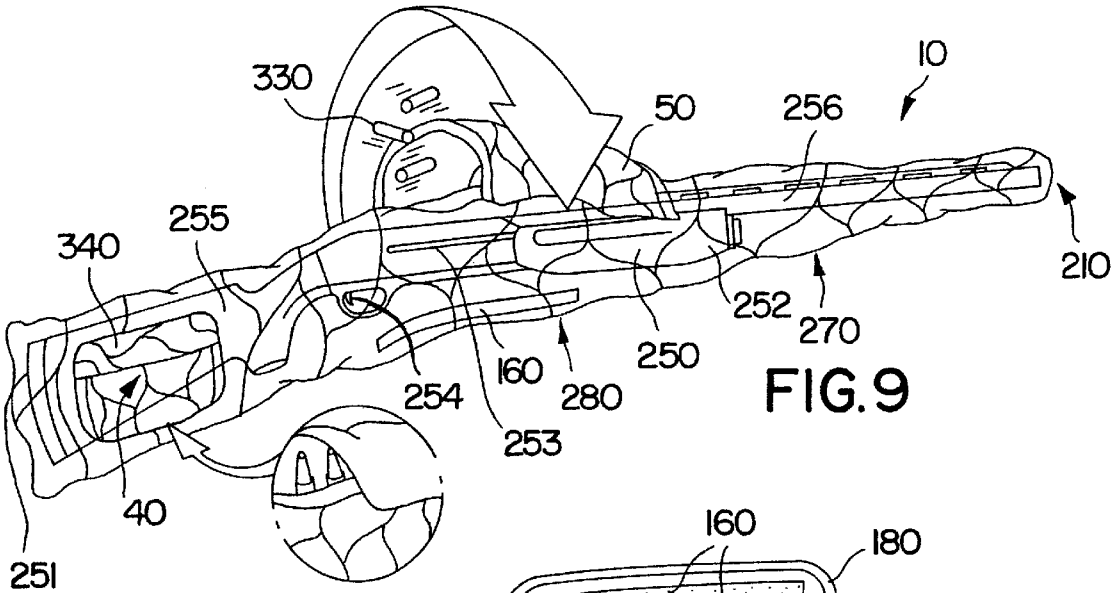
FIG. 9 is a perspective view thereof showing the upper flap in a partially opened position and illustrating how the upper flap is used when shells are discharged from the firearm.

FIGS. 8 and 9 are perspective views of a second embodiment of the firearm casing 10 having only an upper flap 50. FIG. 8 shows the upper flap 50 in the closed position and FIG. 9 shows the upper flap 50 in a partially opened position and illustrating how the upper flap 50 is used when shell casings 330 are being discharged from the firearm 250. This embodiment of the present invention is similar to the first embodiment but differs in the following ways: the firearm casing 10 is not as closely contoured to snugly encase the firearm 250, but instead loosely surrounds the firearm 250. This is important as it allows the same firearm casing 10 to be adapted to fit various types, sizes and shapes of firearms 250. Also, in this embodiment there is not an aperture through which the knob 350 can protrude. FIG. 9 shows the upper flap 50 shielding the top portion of the firearm 250 as the shell casings 330 are discharged from the firearm 250. In this position, the upper flap 50 can protect the user from being struck by the shell casings 330 and also help to maintain the shell casings 330 for easy retrieval. This position also allows the firearm 250 to be operated in inclement weather such as rain or snow without being completely exposed to the elements. This firearm casing 10, as well as the other embodiments hereof, can also be used in conjunction with an ammunition pouch 340. A fastening means 160 is located along the lower longitudinal edge 270 to allow the firearm to be accessed from below and to allow the firearm to be placed within and removed from the firearm casing 10. Also, there is a fastening means located at the terminal aperture 210 which can be fastened to prevent foreign objects such as dirt and debris from entering the barrel of the firearm 250.

Figure 10:
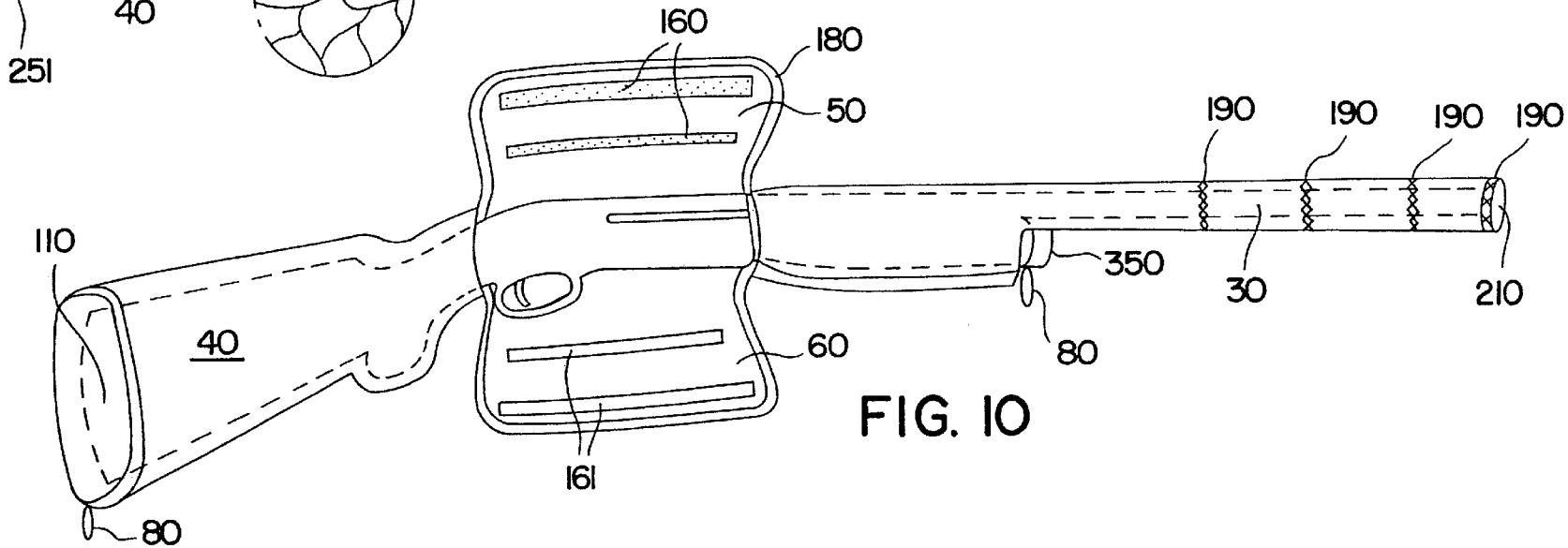
FIG. 10 is a perspective view showing a third embodiment of the firearm casing having both an upper flap and a lower flap shown in partially opened positions exposing the firearm.
Figure 11:
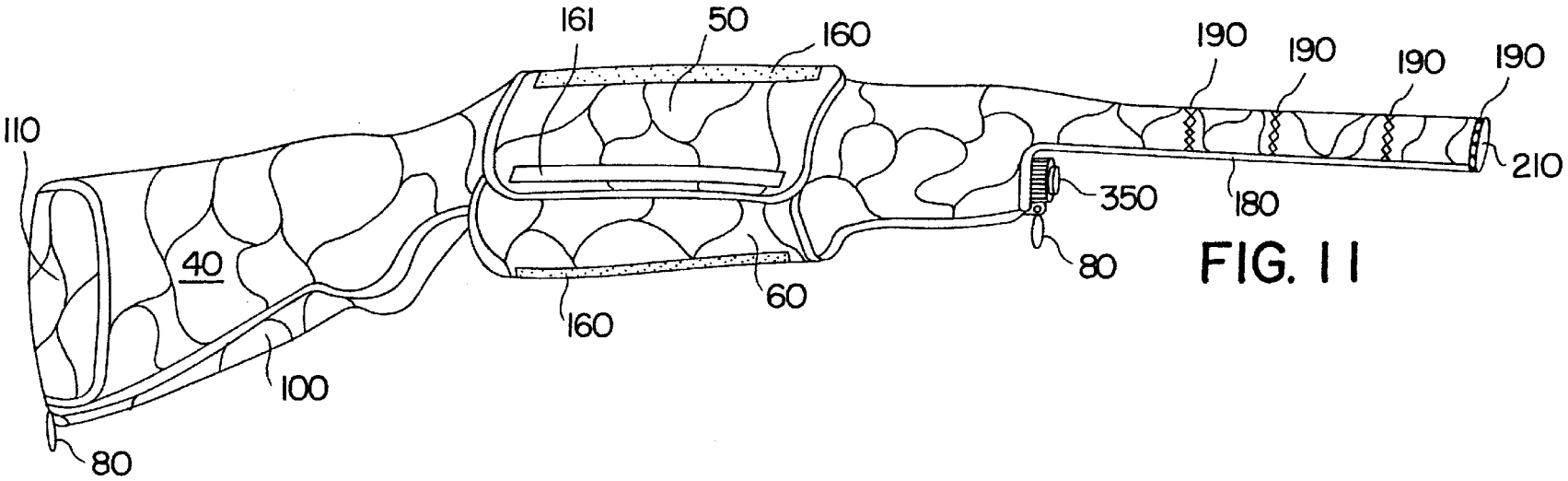
FIG. 11 is a perspective view thereof with both the upper flap and the lower flap in closed positions covering the firearm.

FIGS. 10 and 11 are both perspective views showing a third embodiment of the firearm casing 10 having both an upper flap 50 and a lower flap 60 shown in various positions. FIG. 10 shows the firearm casing 10 with both the upper flap 50 and the lower flap 60 in open positions. FIG. 11 shows the firearm casing 10 with both the upper flap 50 and the lower flap 60 in closed positions covering the firearm 250. This embodiment of the firearm casing has an end flap 110 at the rear portion 40 of the body 20 that wraps around the butt end of the stock end of the firearm 250. It also has a stock flap 100 that wraps around the lower end of the stock end of the firearm 250. As in other embodiments, the strap attachment devices 80 are allowed to protrude out through the firearm casing 10, hence allowing a strap 70 (not shown) to be attached to the firearm 250 for easy transportation. Also, a trim 180 finishes off the various edges of the firearm casing 10. At the front portion 30 of the body 20 of the firearm casing 10, there is a series of bands 190, preferably made of elastic or drawstrings, leading up to and at the terminal aperture 210. These bands 190 help to hold the firearm casing 10 close to the barrel of the firearm 250 and prevent it from sliding around while on the firearm 250. Also in this embodiment, the knob 350 protrudes out through the firearm casing 10 thus allowing the user to access the knob 350 without having to remove the entire firearm casing 10. The lower flap 60 has at least two fastening means 160 located on the outside thereof. Such fastening means are attached to both the upper and lower flaps 50,60 by stitching 161 which shows through on the opposite side of the flaps 50,60 than the fastening means 160 is actually located. The upper flap 50 also has at least two fastening means 160 located on the inside portion thereof. When the lower flap 60 is wrapped around the middle of the firearm 250, the fastening means 160 are then exposed to the outside of the firearm casing 10. As the upper flap 50 is wrapped around the middle of the firearm 250, the fastening means 160 located on the inside of the upper flap 50 then mating connects with the fastening means 160 located on the outside of the lower flap 60 securing both flaps 50,60 tightly and in place. The upper flap 50 also has at least one fastening means 160 located on the outside portion so that if the user desires, the upper flap 50 can be folded or rolled up and fastened to itself with in a similar manner as described above with regard to the first embodiment of the present invention. The lower flap 60 also has at least one fastening means located on the outside portion so as to enable the lower flap 60 to be folded or rolled up in a similar manner and held tightly in place.

Figure 12:
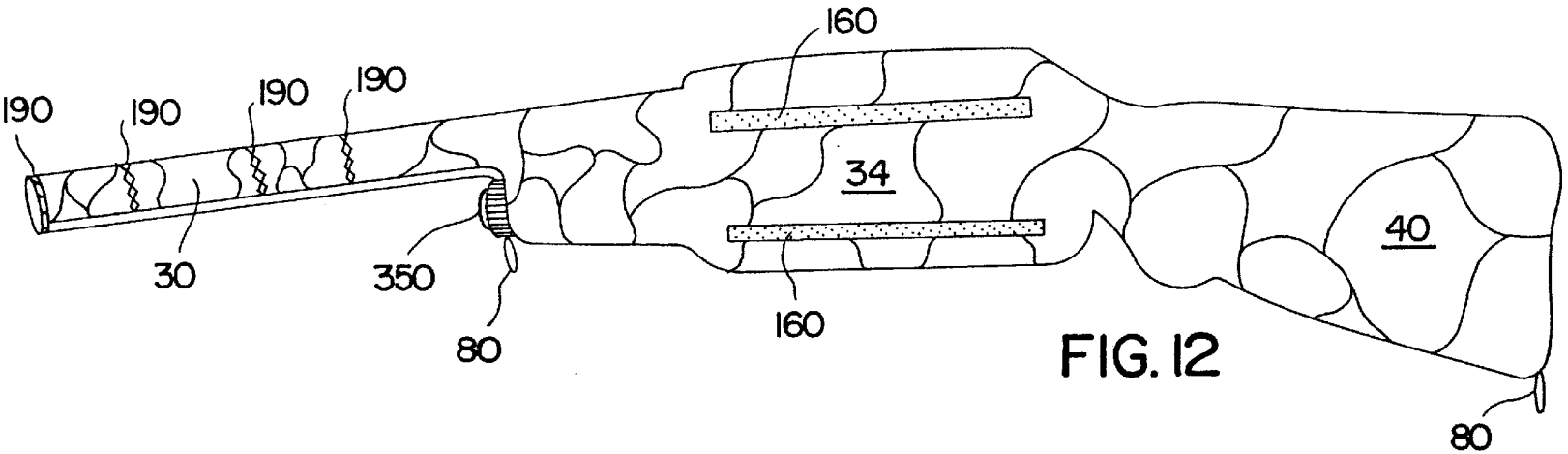
FIG. 12 is a rear elevation view thereof showing both the upper flap and the lower flap in closed positions.

FIG. 12 is a rear elevation view of the firearm casing 10 showing both the upper flap 50 and the lower flap 60 in closed positions. The firearm casing 10 of FIG. 12 has at least two fastening means 160 located within the middle portion 34 of the body 20 in alignment with the upper and lower flaps 50,60. These fastening means 160 are also used to attach either or both the upper flap 50 and the lower flap 60 when they are in the open position by rolling or folding the flaps 50,60 and removably, matingly attaching them to the fastening means 160 on the back side of the firearm casing 10.

The firearm casing 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A firearm casing for protecting a firearm comprising:

a body made of a material and having a front portion, a middle portion, a rear portion, an upper edge and a lower edge;

said upper edge having an upper aperture in said middle portion of said body for a handle;

said lower edge having an access opening in said middle portion of said body for said trigger;

a terminal aperture located at said front portion of said body;

an upper flap for covering said upper aperture;

a lower flap for covering said access opening; and a fastening means for attaching each of said upper flap and said lower flap to said body;

wherein a firearm is held within said body of said firearm casing to allow said firearm to be operated and protected while in said firearm casing.

2. The firearm casing of claim 1, further comprising:

an end flap, a stock flap and a barrel flap, each for securing said firearm casing around said firearm;

said end flap located at said rear portion of said body and between said upper edge and said lower edge;

said stock flap and said barrel flap each being contiguous with said lower edge; and each said stock flap and said barrel flap having said fastening means attached thereto for matingly securing each said flap to at least one of said body or another said flap.

3. The firearm casing of claim 2, further comprising:

said body being contoured to the shape of a firearm wherein said firearm casing snugly and securely encases said firearm.

4. The firearm casing of claim 3, further comprising:

said material being at least one of waterproof and water resistant.

5. The firearm casing of claim 4, further comprising:

said material being camouflage print.

6. The firearm casing of claim 4, further comprising:

said upper flap and said lower flap being removable.

7. The firearm casing of claim 6, further comprising:

said lower edge having a strap attachment fastening means for allowing said body of said firearm casing to be fastened around a strap attachment device on said firearm;

wherein a strap can be attached to said firearm for carrying said firearm while it is encased in said firearm casing.

8. The firearm casing of claim 7, further comprising:

said upper edge having a sight opening for allowing a sight element to protrude through said firearm casing.

9. The firearm casing of claim 7, further comprising:

said upper edge terminating prior to a sight element allowing said sight element to remain unobstructed by said firearm casing.

10. The firearm casing of claim 9, further comprising:

said terminal aperture having said fastening means;

wherein said fastening means closes said terminal aperture to protect the open end of a barrel of said firearm.

11. The firearm casing of claim 10, further comprising:

said lower flap having a grip flap for securing around a firearm grip;

wherein said grip flap wraps around a grip on a firearm and maintains said firearm casing in a secure and fixed position around said firearm.

12. The firearm casing of claim 11, further comprising:

a magazine casing for covering and protecting a magazine on a firearm.

13. The firearm casing of claim 12, further comprising:

said fastening means are hook and loop fasteners.

14. The firearm casing of claim 13, further comprising:

said upper flap is capable of being folded back and fastened to itself with said fastening means; and said lower flap is capable of being folded back and fastened to itself with said fastening means;

wherein said upper and lower flaps can be folded back so that each said flap does not interfere with the use of said firearm.

15. A casing for a firearm comprised of:

a body having a rear portion, a middle portion and a front portion;

an upper flap connected to said middle portion of said body that can be removed to allow for shells to be discharged from said firearm while said firearm is within said firearm casing;

a terminal aperture at said front portion of said body;

at least one fastening means connected to said body to fasten various parts of said casing to other parts of said casing;

wherein a firearm is capable of being operated, transported and stored while encased in said casing;

said body is contoured to fit a firearm;

one of said fastening means being located at said terminal aperture and can be operated to cover said terminal aperture to prevent foreign objects from entering a barrel on said firearm.

16. The firearm casing of claim 15, further comprising:

said casing being made of light-weight, waterproof, camouflage material.

17. A firearm casing for covering a firearm comprising:

a body being made of a material and having a front portion, a middle portion, a rear portion, an upper edge, and a lower edge;

an opening located in said middle portion allowing access to a trigger portion of said firearm;

an access opening located along said lower edge allowing said firearm to be inserted and removed from said firearm casing;

an upper flap for covering an upper portion of said opening and having a first fastening means for holding said upper flap in a preferred position;

a lower flap for covering a lower portion of said opening and having a second fastening means for holding said lower flap in a preferred position;

an end flap for covering an end said rear portion of said firearm casing and having a third fastening means for fastening said end flap in a preferred position; and a terminal aperture located at the end of said front portion and having a fourth fastening means for closing said terminal aperture;

wherein said firearm casing allows for said firearm to be operated while covered with said firearm casing.

18. The firearm casing of claim 17, further comprising:

said material being at least one of waterproof and water resistant.

19. The firearm casing of claim 18, further comprising:

said upper flap and said lower flap being partially removable.

* * * * *